United States Patent [19]

Flax

[11] 4,286,718

[45] Sep. 1, 1981

[54] DISPLAY AND STORAGE RACK

[75] Inventor: Leonard Flax, New York, N.Y.

[73] Assignee: The Frame Company, Inc., Jersey City, N.J.

[21] Appl. No.: 118,400

[22] Filed: Feb. 4, 1980

[51] Int. Cl.[3] ..... A47F 5/01

[52] U.S. Cl. ..... 211/181; 248/175

[58] Field of Search ..... 211/181, 49 R, 106; 248/175

[56] References Cited

U.S. PATENT DOCUMENTS

| | | | |
|---|---|---|---|
| 2,186,883 | 1/1940 | Robinson | 211/181 UX |
| 2,799,401 | 7/1957 | Duchin | 211/181 X |
| 3,995,744 | 12/1976 | Metcalf | 211/181 X |

FOREIGN PATENT DOCUMENTS

| | | | |
|---|---|---|---|
| 623551 | 5/1949 | United Kingdom | 211/106 |

*Primary Examiner*—Ramon S. Britts
*Assistant Examiner*—Robert W. Gibson, Jr.
*Attorney, Agent, or Firm*—James J. Burke, II

[57] ABSTRACT

A point-of-sale rack for display and open-stock storage of plastic (acrylic) picture holders. Preferably fabricated from wire stock, the rack provides a novel tripartite support system for the display of each size of frame offered for sale, and, directly underneath each displayed frame, means for compactly supporting a supply of the frames displayed. The rack may be fabricated readily for either counter-top or floor usage, depending on the number of tiers of display/storage couples that are desired.

4 Claims, 4 Drawing Figures

DISPLAY AND STORAGE RACK

BACKGROUND OF THE INVENTION

The present invention relates in general to display and storage racks and, more particularly, the invention is a novel rack adapted to display plastic picture frames of a specific type. Additionally, the rack provides storage means associated with frames of each displayed size, so that customers may readily make a selection for purchase. The referenced frames are generally fabricated from ⅛" clear acrylic plastic, and comprise a single piece bent into a general "L" shape, the vertical leg being doubled-back to form a picture holding area, and the horizontal leg forming a base (see FIG. 4). Such frames are in wide popular use, and are sold in a variety of sizes.

OBJECTS OF THE INVENTION

It is an object of the present invention to provide a rack for display and storage of frames of the type described.

A further object of the invention is to provide a rack for display of frames of the type described, with means for storing a substantial number of frames of the same size immediately below each displayed frame.

Various other objects and advantages of the invention will become clear from the following description of a preferred embodiment of the invention, and the novel features will be particularly pointed out in connection with the appended claims.

THE DRAWINGS

Reference will hereinafter be made to the accompanying drawings, wherein.

DESCRIPTION OF THE EMBODIMENTS

The invention will be described as having two levels of display and two levels of storage, but it will be appreciated that it is not so limited .

Figure 3:
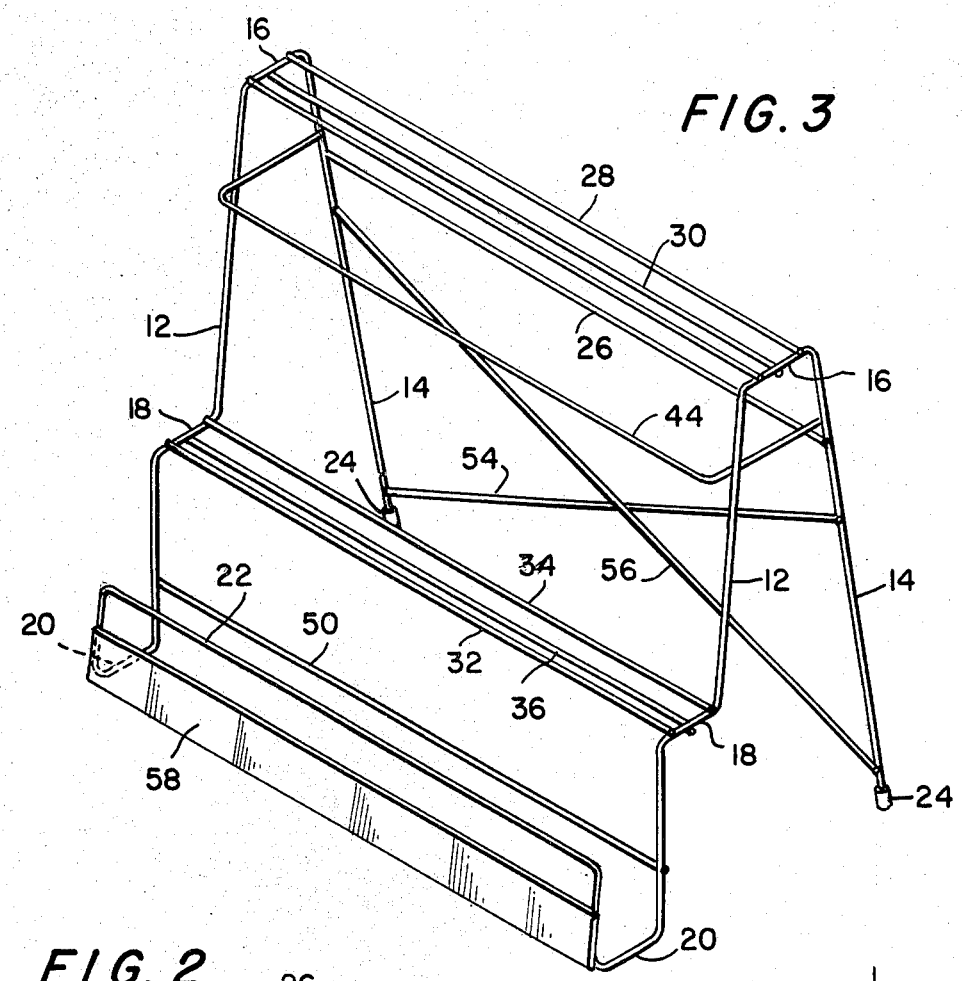
FIG. 3 is a perspective view of the FIG. 1 embodiment.
Figure 2:
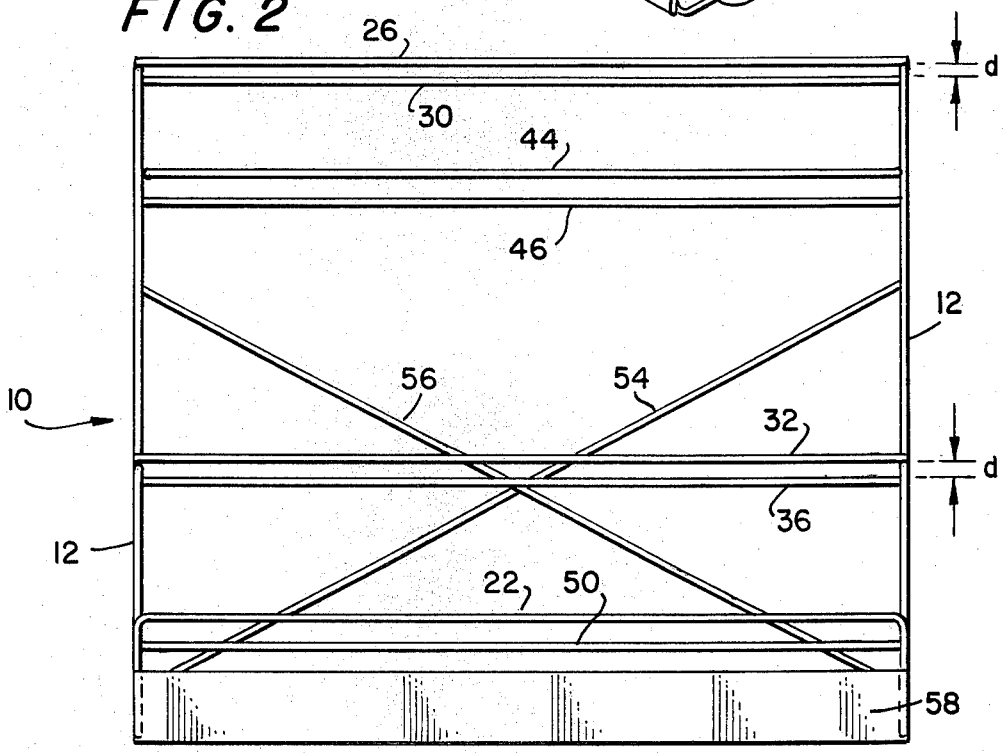
FIG. 2 is a front elevation view of the embodiment of FIG. 1.

Referring to the drawings, it is preferred to fabricate the entire rack 10 from ⅛" nickel-plated steel wire stock, but this size is needed only for the end pieces 12 which, as can be seen in FIG. 3, may be bent to shape from a single length of wire. Cross-pieces, as described hereinbelow, may be of smaller sized wire stock.

End-pieces 12 are bent to form a pair of rear legs 14, a first horizontal display rod support 16, a second lower horizontal display rod support 18, horizontal front base members 20, and a frontal connecting member of a general inverted U-shape 22. Rubber tips 24 are conveniently provided on rear legs 14.

Each of the horizontal display rod support areas, 16—16, 18—18, is connected by three, spaced frame support rods. These are designated as rods 26, 28, and 30 between supports 16—16, and as rods 32, 34, 36 between supports 18—18. A feature of the invention is that, the two outer or distal rods (26,28) (32,34) are attached, as by spot welding, to one side of the end piece 12, while the central rod 30, 36 is attached to the other side. As shown in the drawings, rods 26, 28 are attached to the upper side and rod 30 is attached to the lower side, but these positions could be reversed.

Figure 4:
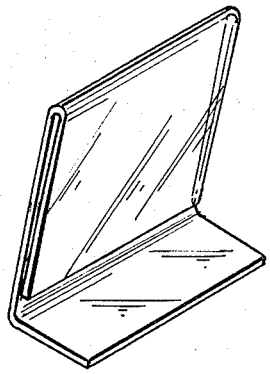
FIG. 4 is a perspective view of a plastic picture frame of the type adapted for use with the invention.
Figure 1:
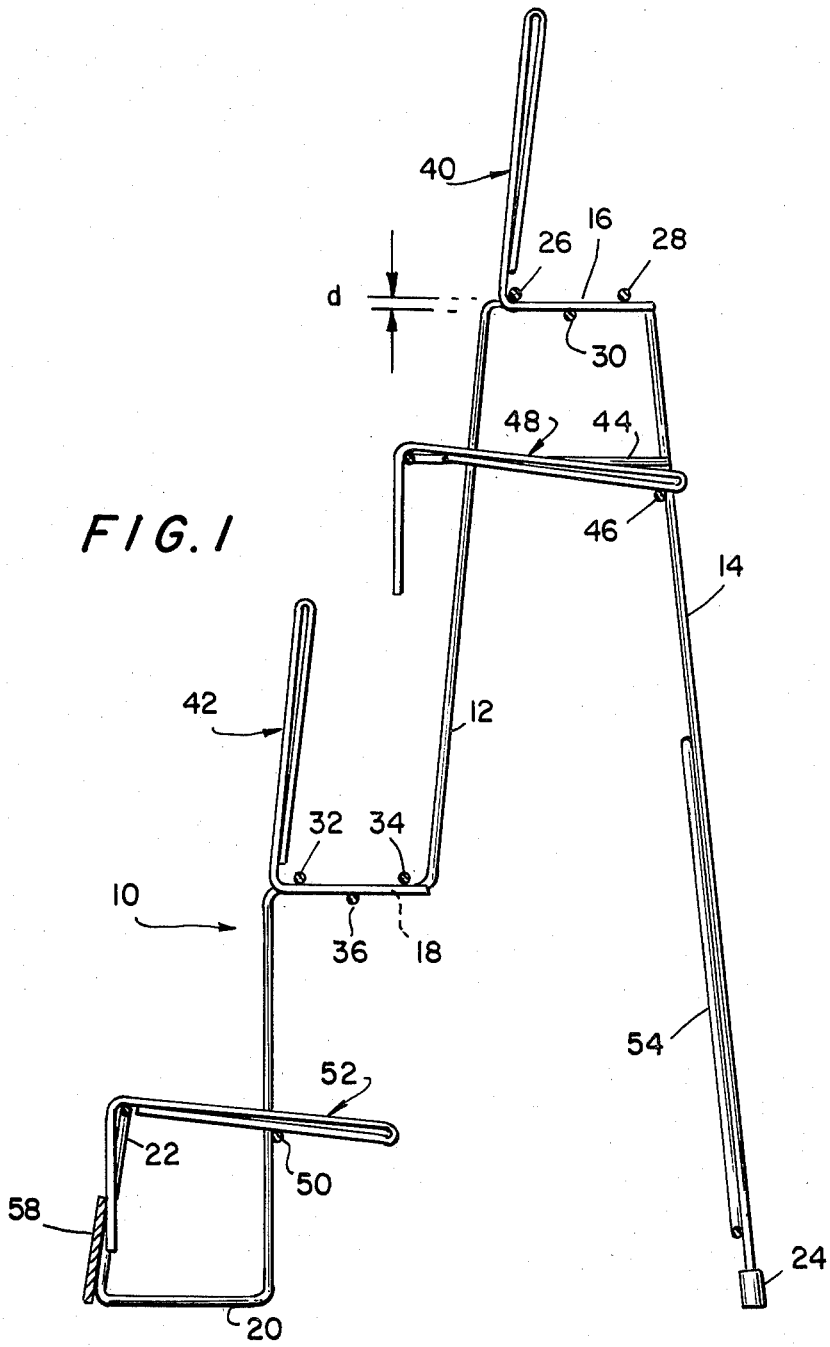
FIG. 1 is a side elevation view of a preferred embodiment of the invention.

By this means, rods 26, 28, 30 form a tripartite support for the base 38 of an acrylic frame 40 (shown in phantom) since the wire 12 and base 38 are both ⅛" thick. As best seen in FIG. 1, frames 40, 42 are firmly held in the upright position, on display, by the respective support rods. The rods have a degree of resiliency, so an easy, sliding fit results. The key feature is that the vertical distance "d" between the opposed surfaces of rods 26, 28, 30 be equal to the thickness of base 38 of frame 40.

Below horizontal rod support area 16, a u-shaped cross member 44 is attached between end pieces 12, the legs preferably extending back to rear legs 14. A second, straight cross member 46 is attached between rear legs 14 below cross member 44. The base of member 44 and member 46 provide support for stored frames 48 (one shown).

Thus, immediately below display frame 40 is a stack of frames 48 of the same size.

Similarly, storage of frames of the size of frame 42 is provided by two cross members: member 22 which is integral with end pieces 12, and an additional cross piece 50 extending between the front legs of end pieces 12. Thus, immediately below displayed frame 42 is a stack of frames 52 (one shown) of the same size.

For additional structural integrity, a pair of crossed braces 54, 56 connect the rear legs 14. A sign 58 may be attached across the front. While the invention has been described as being fabricated from ⅛" steel wire, it will be appreciated that variations are possible. For example, end pieces 12 could be replaced by solid panels, such as Formica (TM) covered particle board. It is only essential that tripartite support members form a horizontal space equal to the thickness of the base of the frame. Also, while the described embodiment is adapted for counter-top display and storage of frames, it could well be adapted for floor use, with considerably greater capacity.

Various other changes in the details, materials, and arrangements of parts, which have been herein described and illustrated to explain the nature of the invention, may be made by those skilled in the art within the principle and scope of the invention as defined in the appended claims.

What is claimed is:

1. A display and storage rack for picture frames that have a horizontal base member, said rack comprising:

spaced, parallel end pieces;

three spaced parallel display frame support rods extending between said end pieces, the outer two rods being vertically spaced from the inner rod by a distance equal to the thickness of said frame base member, forming a tripartite support for a picture frame base member; and two parallel storage frame support rods extending between said end pieces below said display frame support rods and adapted to support a stack of said frames.

2. The display and storage rack as claimed in claim 1, wherein said end pieces are fabricated from ⅛" wire stock, and said display frame support rods are attached to horizontal sections of same, said vertical space being provided by attachment of said frame support rods to respective upper and lower surfaces of said horizontal sections.

3. The display and storage rack as claimed in claim 1, and additionally comprising cross members between said end pieces to provide additional structural strength.

4. The display and storage rack as claimed in claim 2 wherein said outer rods are attached to the upper surface of said wire, and the inner rod is attached to the lower surface of said wire.

* * * * *